US009472335B2

(12) United States Patent
Sun et al.

(10) Patent No.: US 9,472,335 B2
(45) Date of Patent: Oct. 18, 2016

(54) TRANSFORMER MODULE FOR ELECTRIC VEHICLE

(71) Applicant: LSIS CO., LTD., Anyang-si, Gyeonggi-do (KR)

(72) Inventors: Jong In Sun, Incheon (KR); Woo Sup Kim, Seoul (KR); Bo Hyun Youn, Seoul (KR); Chun Suk Yang, Seongnam-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/147,304

(22) Filed: Jan. 3, 2014

(65) Prior Publication Data

US 2014/0266554 A1 Sep. 18, 2014

(30) Foreign Application Priority Data

Mar. 13, 2013 (KR) ..... 10-2013-0026937

(51) Int. Cl.

| | |
|---|---|
| ***H01F 17/04*** | (2006.01) |
| ***H01F 27/30*** | (2006.01) |
| ***H01F 5/00*** | (2006.01) |
| ***H01F 27/24*** | (2006.01) |
| ***H01F 27/28*** | (2006.01) |
| *H01F 27/06* | (2006.01) |

(52) U.S. Cl.

CPC ..... *H01F 27/2866* (2013.01); *H01F 2027/065* (2013.01); *H01F 2027/2814* (2013.01)

(58) Field of Classification Search

CPC ..... H01F 27/06; H01F 27/2866; H01F 2027/065

USPC ..... 336/221, 198, 200, 208, 212

See application file for complete search history.

(56) References Cited

U.S. PATENT DOCUMENTS 5,359,313 A * 10/1994 Watanabe ..... H01F 3/14 336/178
5,565,837 A * 10/1996 Godek ..... H01F 17/0006 174/250
5,684,445 A * 11/1997 Kobayashi et al. ..... 336/83
6,522,233 B1 * 2/2003 Kyoso et al. ..... 336/200

(Continued)

FOREIGN PATENT DOCUMENTS

CN 102412057 4/2012
JP 55-166913 12/1980

(Continued)

OTHER PUBLICATIONS

European Patent Office Application Serial No. 14150523.0, Search Report dated May 27, 2014, 10 pages.

(Continued)

*Primary Examiner* — Elvin G Enad
*Assistant Examiner* — Kazi Hossain
(74) *Attorney, Agent, or Firm* — Lee Hong Degerman Kang & Waimey; Jonathan Kang; Jeffrey Lotspeich

(57) ABSTRACT

A transformer module for an electric vehicle is provided. The transformer module includes a bobbin round which a primary-side coil is wound, a printed circuit board, and a secondary-side bus bar disposed between the bobbin and the printed circuit board, wherein a pattern part formed of an electrically conductive material to contact the bus bar is provided on the printed circuit board to electrically connect the pattern part to the bus bar in parallel.

4 Claims, 4 Drawing Sheets

(56) References Cited

U.S. PATENT DOCUMENTS

| | | | | |
|---|---|---|---|---|
| 6,879,235 | B2 * | 4/2005 | Ichikawa | 336/200 |
| 7,248,138 | B2 * | 7/2007 | Chiang et al. | 336/200 |
| 2001/0033216 | A1 * | 10/2001 | Shirahata et al. | 336/5 |
| 2007/0057757 | A1 | 3/2007 | Chen et al. | |
| 2007/0171022 | A1 * | 7/2007 | Marui | H01F 5/02 336/200 |
| 2008/0088401 | A1 | 4/2008 | Wei | |
| 2008/0211613 | A1 * | 9/2008 | Lin | H01F 27/2866 336/83 |
| 2008/0297297 | A1 * | 12/2008 | Lin | H01F 27/2847 336/107 |
| 2010/0219926 | A1 * | 9/2010 | Willers | H01F 27/06 336/200 |
| 2010/0265029 | A1 * | 10/2010 | Xiong et al. | 336/232 |
| 2011/0050379 | A1 | 3/2011 | Kim | |
| 2011/0115598 | A1 * | 5/2011 | Wu et al. | 336/212 |
| 2012/0032770 | A1 * | 2/2012 | Sohn | H01F 27/22 336/221 |
| 2012/0154095 | A1 * | 6/2012 | Li et al. | 336/199 |
| 2013/0099885 | A1 * | 4/2013 | Park | H01F 27/2804 336/170 |

FOREIGN PATENT DOCUMENTS

| | | |
|---|---|---|
| JP | 05-55048 | 3/1993 |
| JP | 2003-197439 | 7/2003 |
| JP | 2005012005 | 1/2005 |
| JP | 2007067268 | 3/2007 |
| JP | 2008-004823 | 1/2008 |
| JP | 2008-177486 | 7/2008 |
| JP | 2009-170804 | 7/2009 |
| JP | 2011077328 | 4/2011 |
| JP | 2011198898 | 10/2011 |

OTHER PUBLICATIONS

Korean Intellectual Property Office Application Serial No. 10-2013-0026937, Notice of Allowance dated Feb. 3, 2014, 2 pages.

The State Intellectual Property Office of the People's Republic of China Application Serial No. 201410075192.2, Office Action dated Nov. 11, 2015, 8 pages.

Japan Patent Office Application Serial No. 2014-005868, Office Action dated Feb. 12, 2015, 2 pages.

* cited by examiner

TRANSFORMER MODULE FOR ELECTRIC VEHICLE

CROSS-REFERENCE TO RELATED APPLICATIONS

Pursuant to 35 U.S.C. §119(a), this application claims the benefit of earlier filing date and right of priority to Korean Application No. 10-2013-0026937, filed on Mar. 13, 2013, the contents of which is incorporated by reference herein in its entirety.

BACKGROUND

The present disclosure relates to a transformer module for an electric vehicle, and more particularly, to a transformer module for an electric vehicle, in which a transformer and a printed circuit board (PCB) are modularized to reduce the number of processes and manufacturing costs in a manufacturing process thereof.

Recently, as the interest in environmental-friendly vehicles has being emphasized due to environmental problems, the expectation for the electric vehicles of the environmental-friendly vehicles is increasing.

Such an electric vehicle includes a transformer as an electronic component.

Generally, transformers are devices which receive AC power from one circuit to supply the AC power to the other circuit by using electromagnetic induction. In the transformers, a voltage is in proportion to a turn ratio of a primary-side coil to a secondary-side coil, and current is in inverse proportion to the turn ratio.

Transformers used in the electric vehicles have to allow high current to flow therethrough, have high efficiency, and be miniaturized to be installed in a narrow space.

FIG. 1 is a perspective view of a transformer used in an electric vehicle according to the related art.

Referring to FIG. 1, a transformer of an electric vehicle of the related art includes an upper ferrite core 10, an upper bobbin 20 coupled to a lower portion of the upper ferrite core 10, an upper bus bar 30 disposed on a lower portion of the upper bobbin 20, a lower bus bar 50 disposed on a lower portion of the upper bus bar 30, a lower bobbin 60 disposed on a lower portion of the lower bus bar 50, and a lower ferrite core 70 disposed on a lower portion of the lower bobbin 60.

A support 40 having a ring shape is disposed between the upper bus bar 30 and the lower bus bar 50 to prevent mechanical wobble from occurring.

If the above-described constitutions are provided, since each of the upper and lower bus bars 30 and 50 should have a cross-sectional area of a predetermined size or more to allow high current to flow therethrough, the transformer may increase in overall size. Thus, it is difficult to manufacture a small-sized transformer.

In addition, after the transformer including the above-described constitutions is manufactured, the transformer has to move to a separate manufacturing line so as to attach a printed circuit board thereto through an impregnation process. Thus, it is required to develop an effective manufacturing process.

SUMMARY

Embodiment provide a transformer module for an electric vehicle, in which a bus bar is reduced in size to allow the transformer module to be miniaturized, and a printed circuit board (PCB) and a transformer are integrated to reduce the number of assembling processes and manufacturing costs.

In one embodiment, a transformer module for an electric vehicle, the transformer module includes: a bobbin round which a primary-side coil is wound; a printed circuit board; and a secondary-side bus bar disposed between the bobbin and the printed circuit board, wherein a pattern part formed of an electrically conductive material to contact the bus bar is provided on the printed circuit board to electrically connect the pattern part to the bus bar in parallel.

The pattern part may have a shape corresponding to that of the bus bar.

The pattern part may include: an upper pattern disposed on a top surface of the printed circuit board; and a lower pattern disposed on a bottom surface of the printed circuit board, wherein the bus bar may include: an upper bus bar contacting the upper pattern; and a lower bus bar contacting the lower pattern, wherein the bobbin may include: an upper bobbin disposed on an upper portion of the upper bus bar, a lower bobbin disposed on a lower portion of the lower bus bar.

The transformer module may further include a ferrite core, wherein the ferrite core may include: a central part vertically extending from a center thereof; and a sidewall part spaced apart from the central part to vertically extend, wherein a first cutoff part having a shape corresponding to that of the sidewall part vertically may pass through the printed circuit board.

The bus bar may be a plate-shaped member of which a portion of a center has a ring shape, the pattern part may have the same shape as the bus bar, and a portion of a center of the pattern part has a ring shape, and a second cutoff part vertically passing through may be disposed inside the ring-shaped portion of the pattern part on the printed circuit board.

The pattern part may be formed of a material having superior electrical conductivity than that of the bus bar.

The pattern part may be printed on the printed circuit board.

The details of one or more embodiments are set forth in the accompanying drawings and the description below. Other features will be apparent from the description and drawings, and from the claims.

DETAILED DESCRIPTION OF THE EMBODIMENTS

Hereinafter, a transformer module for an electric vehicle according to an embodiment will be described in detail with reference to the accompanying drawings.

Figure 1:
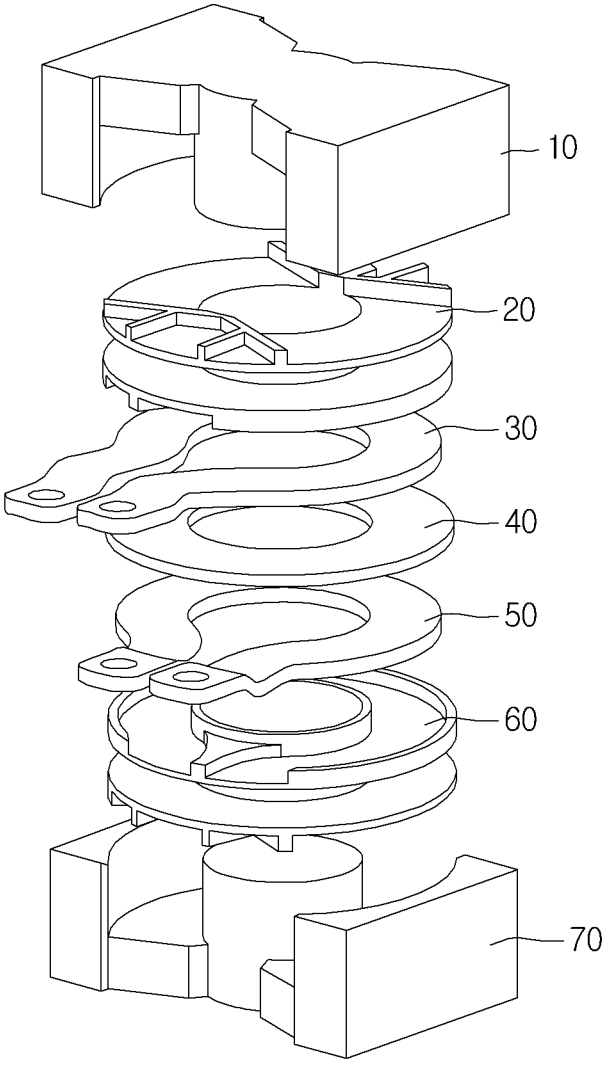
FIG. 1 is an exploded perspective view illustrating a transformer of an electric vehicle according to a related art.
Figure 2:
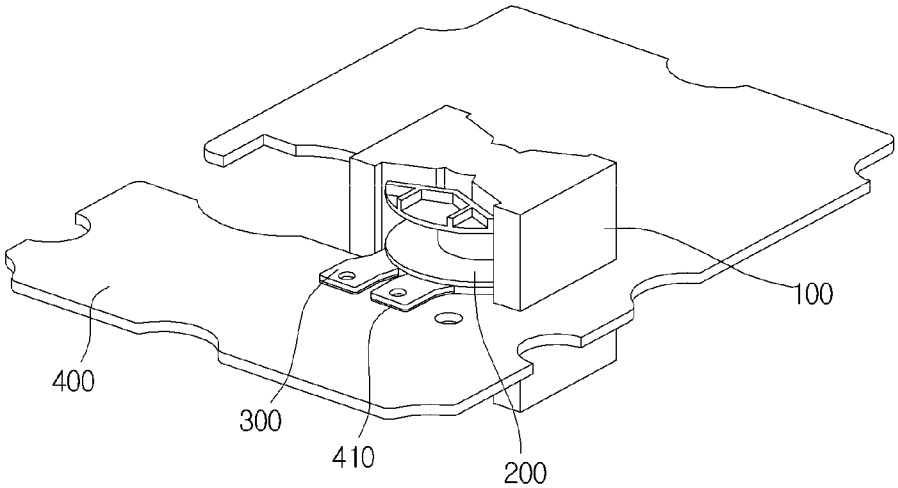
FIG. 2 is a perspective view illustrating a transformer of an electric vehicle according to an embodiment.
Figure 3:
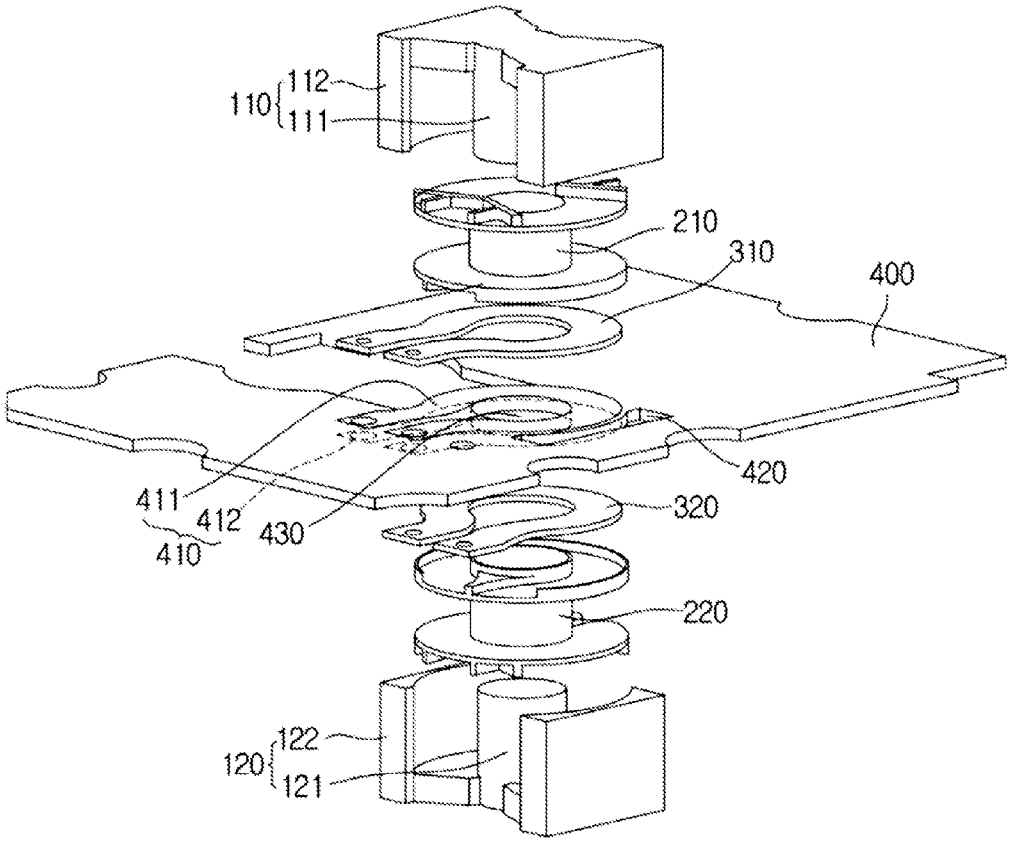
FIG. 3 is an exploded perspective view illustrating the transformer of the electric vehicle according to embodiment.

FIG. 2 is a perspective view illustrating a transformer of an electric vehicle according to an embodiment, and FIG. 3 is an exploded perspective view illustrating the transformer of the electric vehicle according to the embodiment.

Referring to FIGS. 2 and 3, a transformer module for an electric vehicle according to the current embodiment is embodied by coupling a transformer to a printed circuit board (PCB) 400 to modularize the coupled transformer and PCB. The transformer may include a ferrite core 100, a bobbin 200 round which a primary-side coil is wound, and a secondary-side bus bar 300. A pattern part 410 through which current flows is disposed on the PCB 400 in parallel with the bus bar 300.

In detail, as shown in FIG. 2, the transformer module for the electric vehicle according to the current embodiment may include the ferrite core 100. As shown in FIG. 3, the ferrite core 100 may include an upper ferrite core 110 and a lower ferrite core 120.

The upper ferrite core 110 has a cylindrical shape and includes a central part 111 vertically extending downward from a center of the upper ferrite core 110, a sidewall part 112 provided in a pair on both sidewalls of the central part 111 in a transverse direction. Like the central part 111, the sidewall part 112 vertically extends downward.

Like the upper ferrite core 110, the lower ferrite core 120 may include a central part 121 and a sidewall part 122. The lower ferrite core 120 and the upper ferrite core 110 may have shapes that are vertically symmetrical to each other.

As shown in FIG. 2, the transformer module for the electric vehicle according to the current embodiment may further include the bobbin 200. As shown in FIG. 3, the bobbin 200 may include an upper bobbin 210 and a lower bobbin 220.

The upper bobbin 210 and the lower bobbin 220 may have shapes that are vertically symmetrical to each other. Each of the upper and lower bobbins 220 and 210 has a cylindrical hollow part in which a central portion of the ferrite core is inserted. A primary-side coil (not shown) is wound round the outside of the ferrite core and connected to a high-voltage battery (not shown) of the electric vehicle.

As shown in FIG. 2, the transformer module for the electric vehicle according to the embodiment may further include the bus bar 300. As shown in FIG. 3, the bus bar 300 may include an upper bus bar 310 and a lower bus bar 320.

The bus bar 300 may be a plate-shaped member of which a portion of a center has a ring shape. The bus bar 300 has both ends facing the same direction. The bus bar 300 may be formed of a conductive material such as copper (Cu).

As shown in FIGS. 2 and 3, the transformer module for the electric vehicle according to the embodiment may further include the PCB 400. The PCB 400 is disposed between the upper bus bar 310 and the lower bus bar 320.

Figure 3A:
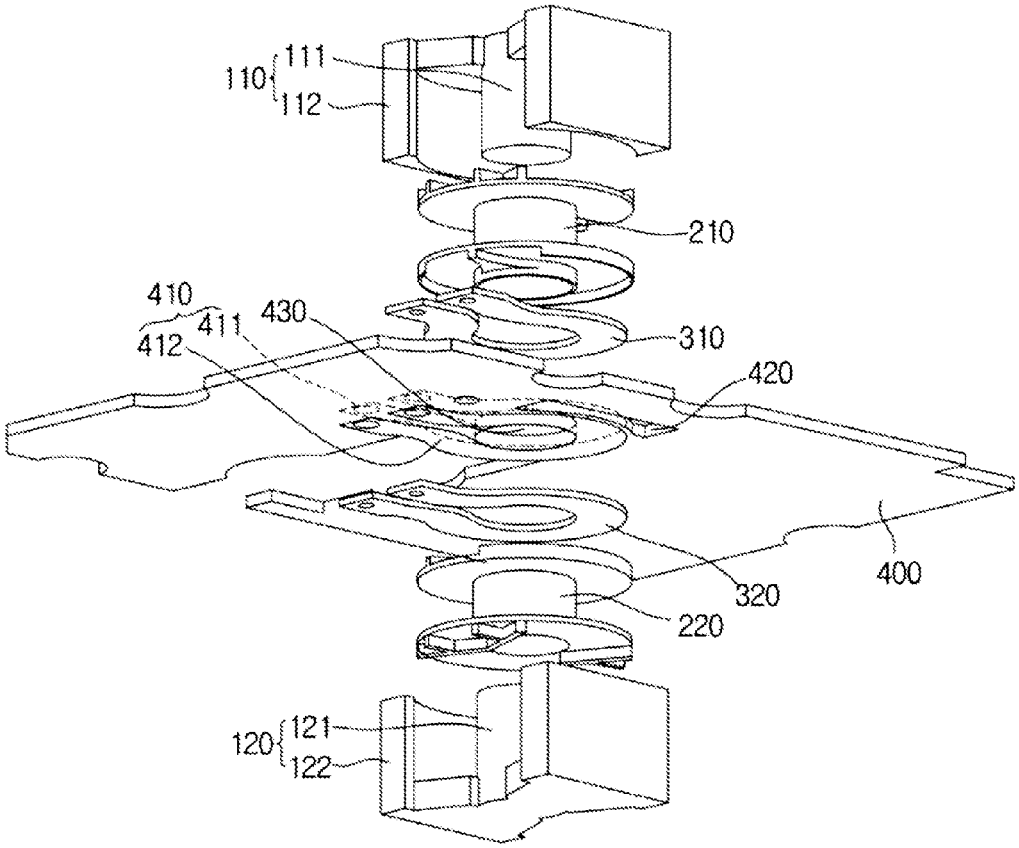
FIG. 3A is an alternate view of the exploded perspective view of the transformer of the electric vehicle shown in FIG. 3.

The pattern part 410 is disposed on the PCB 400. The pattern part 410 may include an upper pattern 411 disposed on a top surface of the PCB 400 and a lower pattern 412 disposed on a bottom surface of the PCB 400 as shown in the alternate view of FIG. 3A.

The pattern part 410 may be formed of the conductive material and have a shape corresponding to that of each of the upper bus bar 310 and the lower bus bar 320.

In more detail, a portion of a center of each of the upper and lower bus bars 310 and 320 has a ring shape, and both ends of each of the upper and lower bus bars 310 and 320 face the same direction. Thus, the upper pattern 411 and the lower pattern 412 may also have the same shape as that of each of the upper and lower bus bars 310 and 320.

That is, the upper pattern 411 has the same as the upper bus bar 310, and the lower pattern 412 has the same as the lower bus bar 320.

The pattern part 410 may be printed on the PCB 400.

A first cutoff part 420 vertically passes through the outside of the pattern part 410. The first cutoff part 420 may have a shape corresponding to that of each of the sidewall parts 112 and 122 of the ferrite core 100. When the transformer and the printed circuit board 400 are assembled as one module, the first cutoff part 420 may be a part in which at least one of the sidewall part 112 of the upper ferrite core 110 or the sidewall part 122 of the lower ferrite core 120 is inserted, or both sidewall parts 112 and 122 are inserted.

A second cutoff part 430 is formed in a central portion of the pattern part 410. In more detail, the ring-shaped central portion of the pattern part 410 is circularly punched to form a space vertically passes through the pattern part 410. Here, the space is defined as the second cutoff part 430.

The second cutoff part 430 may have a shape corresponding to central parts 111 and 121 of the ferrite core 100. The second cutoff part 430 has the same diameter as that of each of the central parts 111 and 121 or a diameter greater than that of each of the central part 111 and 121.

In summary again of the arrangement between the above-described constitutions, the upper ferrite core 110, the upper bobbin 210, the upper bus bar 310, the PCB 400, the lower bus bar 320, the lower bobbin 220, and the lower ferrite core 120 are sequentially disposed downward. Here, the central part 111 of the upper ferrite core 110, the second cutoff part 430, and the central part 121 of the lower ferrite core 120 are vertically aligned in the same line. Also, the sidewall part 112 of the upper ferrite core 110, the first cutoff part 420, and the sidewall part 122 of the lower ferrite core 120 are vertically aligned in the same line.

Also, these constitutions are coupled to each other to constitute one module. As such, when the transformer and the PCB are modularized, the number of parts to be managed may decrease. Thus, when electrical devices of the vehicle are assembled, the number of assembling processes may decreases to quickly assemble the electrical devices, thereby reducing manufacturing costs.

Thereafter, functions of the transformer module for the electric vehicle including the above-described constitutions will be described.

The primary-side coil (not shown) is wound round the bobbin 200 and connected to the high-voltage battery (not shown) having a relatively high voltage. The high-voltage battery is connected to a charging device separately provided outside the vehicle and then charged. For example, the high-voltage battery may have a voltage of about 200 V to about 450 V. Current applied to the primary-side coil (not shown) is delivered to a low-voltage battery (not shown) having a relatively lower voltage through the secondary-side bus bar 300 via the transformer. For example, the low-voltage battery may have a voltage of about 12 V. The low-voltage battery may provide power for operating electrical devices for the vehicle such as a wiper, an audio, a power window, and the like.

Here, the current applied to the low-voltage battery through the secondary-side bus bar 300 flows through the pattern part 410 electrically connected to the bus bar 300 in parallel as well as the bus bar 300.

Unlike that current flows through only a bus bar in the related art, since the current flows through the bus bar 300 and the pattern part 410, the bus bar 300 may have a relatively small cross-sectional area.

Also, as the bus bar 300 decreases in cross-sectional area, the bus bar may also decrease in plane area to reduce an overall size of the bus bar.

Here, in a case where the pattern part 410 is formed of a material having relatively superior electrical conductivity than that of the bus bar 300, the bus bar 300 may further decrease in size.

The reduction in size of the bus bar 300 may enable the transformer to be reduced in overall volume. Furthermore, the transformer and the printed circuit board 400 may be modulated to manufacture more compact transformer module.

According to the embodiment, the transformer may be miniaturized, and the transformer and the PCB may be modularized to simplify the manufacturing process and reduce the number of processes, thereby reducing the manufacturing costs.

In addition, the pattern and the bus bar on the PCB disposed at the secondary-side coil of the transformer may be used at the same time to reduce the volume and the manufacturing costs while increasing current density.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A transformer module for an electric vehicle, the transformer module comprising:

an upper bobbin around which a primary-side coil is wound;

a printed circuit board; and an upper bus bar disposed between the bobbin and the printed circuit board; and an upper pattern part formed of an electrically conductive material provided on the printed circuit board;

wherein the upper pattern part has a shape corresponding to a shape of the upper bus bar and electrically connects to the upper bus bar in parallel, wherein the upper pattern part is formed of a material having superior electrical conductivity than that of the upper bus bar, wherein the upper pattern part is printed on the printed circuit board.

2. The transformer module according to claim 1, wherein the upper pattern part is disposed on a top side of the printed circuit board and the transformer module further comprises:

a lower pattern part disposed on a bottom side of the printed circuit board;

a lower bus bar contacting the lower pattern part; and a lower bobbin disposed on a lower portion of the lower bus bar.

3. The transformer module according to claim 2, further comprising a ferrite core wherein the ferrite core comprises:

a central part vertically extending from a center of the ferrite core; and a sidewall part vertically extending from a position spaced apart from the center;

wherein the printed circuit board comprises a cutoff part opening shaped to correspond to a shape of the sidewall part.

4. The transformer module according to claim 1, wherein:

the upper bus bar is plate-shaped and comprises a center portion having a ring shape; and the upper pattern part comprises a center portion having a ring shape, and the printed circuit board comprises a cutoff part opening passing through the center portion of the upper pattern part.

* * * * *